US007334338B2

(12) United States Patent
Shiba et al.

(10) Patent No.: US 7,334,338 B2
(45) Date of Patent: Feb. 26, 2008

(54) RECIPROCATORY DRY SHAVER

(75) Inventors: Takeshi Shiba, Hikone (JP); Ryo Motohashi, Hikone (JP); Hidekazu Yabuuchi, Hikone (JP); Hiroaki Shimizu, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 113 days.

(21) Appl. No.: 11/189,803

(22) Filed: Jul. 27, 2005

(65) Prior Publication Data

US 2006/0021227 A1 Feb. 2, 2006

(30) Foreign Application Priority Data

Jul. 30, 2004 (JP) ..... 2004-224477

(51) Int. Cl.
*B26B 19/02* (2006.01)

(52) U.S. Cl. ..... 30/43.92; 30/346.51

(58) Field of Classification Search ..... 30/43.91, 30/43.92, 346.51, 43.7, 43.8, 43.9
See application file for complete search history.

(56) References Cited

U.S. PATENT DOCUMENTS

| | | | | |
|---|---|---|---|---|
| 3,042,817 | A | 7/1962 | Mohr | |
| 4,030,573 | A * | 6/1977 | Buzzi et al. | 188/380 |
| 4,631,825 | A * | 12/1986 | Kuriyama et al. | 30/43.92 |
| 4,719,698 | A | 1/1988 | Ninomiya et al. | |
| 4,845,847 | A * | 7/1989 | Yasunaka et al. | 30/34.1 |
| 5,367,771 | A * | 11/1994 | Mukai | 30/43.92 |
| 5,473,818 | A | 12/1995 | Otsuka et al. | |
| 5,632,087 | A * | 5/1997 | Motohashi et al. | 30/43.92 |
| 5,921,134 | A * | 7/1999 | Shiba et al. | 74/110 |
| 6,082,005 | A * | 7/2000 | Tezuka | 30/43.92 |
| 6,559,563 | B1 * | 5/2003 | Shimizu et al. | 310/12 |
| 6,688,002 | B2 * | 2/2004 | Momose et al. | 30/43.92 |
| 6,958,554 | B2 * | 10/2005 | Fujiwara et al. | 310/36 |
| 6,991,217 | B2 * | 1/2006 | Shimizu et al. | 251/284 |
| 2004/0046461 | A1 * | 3/2004 | Shimizu et al. | 310/12 |
| 2004/0163260 | A1 | 8/2004 | Uchiyama | |
| 2004/0231160 | A1 | 11/2004 | Shiba et al. | |

FOREIGN PATENT DOCUMENTS

| | | |
|---|---|---|
| CH | 425 529 | 11/1966 |
| EP | 1 449 627 A1 | 8/2004 |
| JP | 05-048870 U | 6/1993 |
| WO | WO-03/041918 A1 | 5/2003 |

OTHER PUBLICATIONS

European Search Report dated Dec. 9, 2005.

* cited by examiner

*Primary Examiner*—Hwei-Siu C. Payer
(74) *Attorney, Agent, or Firm*—Cheng Law Group PLLC

(57) ABSTRACT

A reciprocatory dry shaver has a shaving head carrying an outer cutter, and an inner cutter. An actuator is mounted in the shaving head for driving the inner cutter. The actuator includes an oscillator which carries a joint for driving connection to the inner cutter. Resilient coupling links are provided to support the oscillator to the shaving head in order to allow the oscillator to reciprocate relative to the shaving head. The resilient coupling link has its upper end coupled to the oscillator and has its lower end which is farther away from the inner cutter than the oscillator and is anchored to the shaving head. Thus, the oscillator is supported as being floated or lifted with respect to the shaving head, thereby being allowed to travel along a path which is somewhat arcuate in coincidence with the arc of the outer cutter.

5 Claims, 7 Drawing Sheets

RECIPROCATORY DRY SHAVER

TECHNICAL FIELD

The present invention is directed to a reciprocatory dry shaver with an arcuately curved outer cutter.

BACKGROUND ART

Japanese Utility Model Publication No. 05-48870 discloses a reciprocatory dry shaver having an outer cutter which is curved arcuately along its length. The shaver has a shaving head with an actuator for driving an inner cutter along the length of the outer cutter for shearing hairs therebetween. The actuator includes an oscillator provided with a joint for connection with the inner cutter. The oscillator is supported to the shaving head by means of resilient coupling link which allows the oscillator to move in relation to the shaving head for driving the inner cutter. The resilient coupling link extends from each of the opposite ends oscillator and is fixed to shaving head at a point closer to the inner cutter than the oscillator such that the oscillator is suspended from that point within the shaving head. Consequently, thus suspended oscillator is caused to travel along a path which is, in principle, arcuately curved to some extent in a direction opposite to the arc of the outer cutter, causing an undesired vertical movement of the inner cutter in contradiction to the arc of the outer cutter. Although the resilient coupling link is designed to absorb such undesired vertical movement, it is not possible to drive the oscillator in conformity with the arc of the outer cutter.

DISCLOSURE OF THE INVENTION

In view of the above problem, the present invention has been accomplished to provide an improved reciprocatory dry shaver which is capable of driving an inner cutter smoothly along an arcuately curved outer cutter for efficient shaving. The dry shaver in accordance with the present invention includes a shaving head carrying an elongated outer cutter which is arcuately curved along its length, and an inner cutter driven to reciprocate along the length of the outer cutter in hair shearing engagement with the outer cutter. An actuator is mounted in the shaving head for driving the inner cutter. The actuator is configured to include an oscillator which reciprocates in the lengthwise direction of the outer cutter and carries a joint for driving connection to the inner cutter. Also included in the actuator is a resilient coupling link which supports the oscillator to the shaving head in order to allow the oscillator to reciprocate relative to the shaving head. The feature of the present invention resides in that the resilient coupling link has its upper end coupled to the oscillator and [the other] its lower end anchored to the shaving head at a portion farther away from the inner cutter than the oscillator. Thus, the oscillator is supported as being floated or lifted with respect to the shaving head, thereby being allowed to travel along a path which is somewhat arcuate in coincidence with the arc of the outer cutter. With this result, the oscillator, i.e., the inner cutter carried thereon can be guided smoothly along the arc of the outer cutter, assuring smooth and efficient shaving.

In a preferred embodiment, the resilient coupling link is realized by a plurality of spring leaves depending from each of opposite lengthwise ends of the oscillator. The plural spring leaves can well withstand a load applied to the inner cutter and therefore the oscillator when pressing the outer cutter against a user's skin, and therefore assuring smooth and efficient shaving.

The actuator is configured to have an anchor plate which extends in parallel with the oscillator and is fixed to the shaving head. The oscillator is elongated and is formed at its lengthwise center with a seat from which the joint projects towards the inner cutter for connection thereto. Formed respectively at opposite lengthwise ends of the oscillator are raised shoulders of which level are higher than the seat, and from which the spring leaves extend to opposite ends of the anchor plate over a length greater than a distance from the seat. With this arrangement, the overall height of the actuator including the joint can be minimized while maintaining the length of the spring leaf sufficient enough for reciprocating the inner cutter along an arcuate path in conformity with the arc of the outer cutter.

Preferably, the oscillator is molded from a plastic material to be integrated with the spring leaves in order to reduce the number of parts and assure easy fabrication of the actuator.

The actuator is preferably provided as a liner motor having a permanent magnet carried on the oscillator and an electromagnet fixed to the anchor plate or the shaving head.

These and still other advantageous features of the present invention will become more apparent from the following description of a preferred embodiment of the present invention when taken in conjunction with the attached drawings.

BEST MODE FOR CARRYING OUT THE INVENTION

Figure 1:
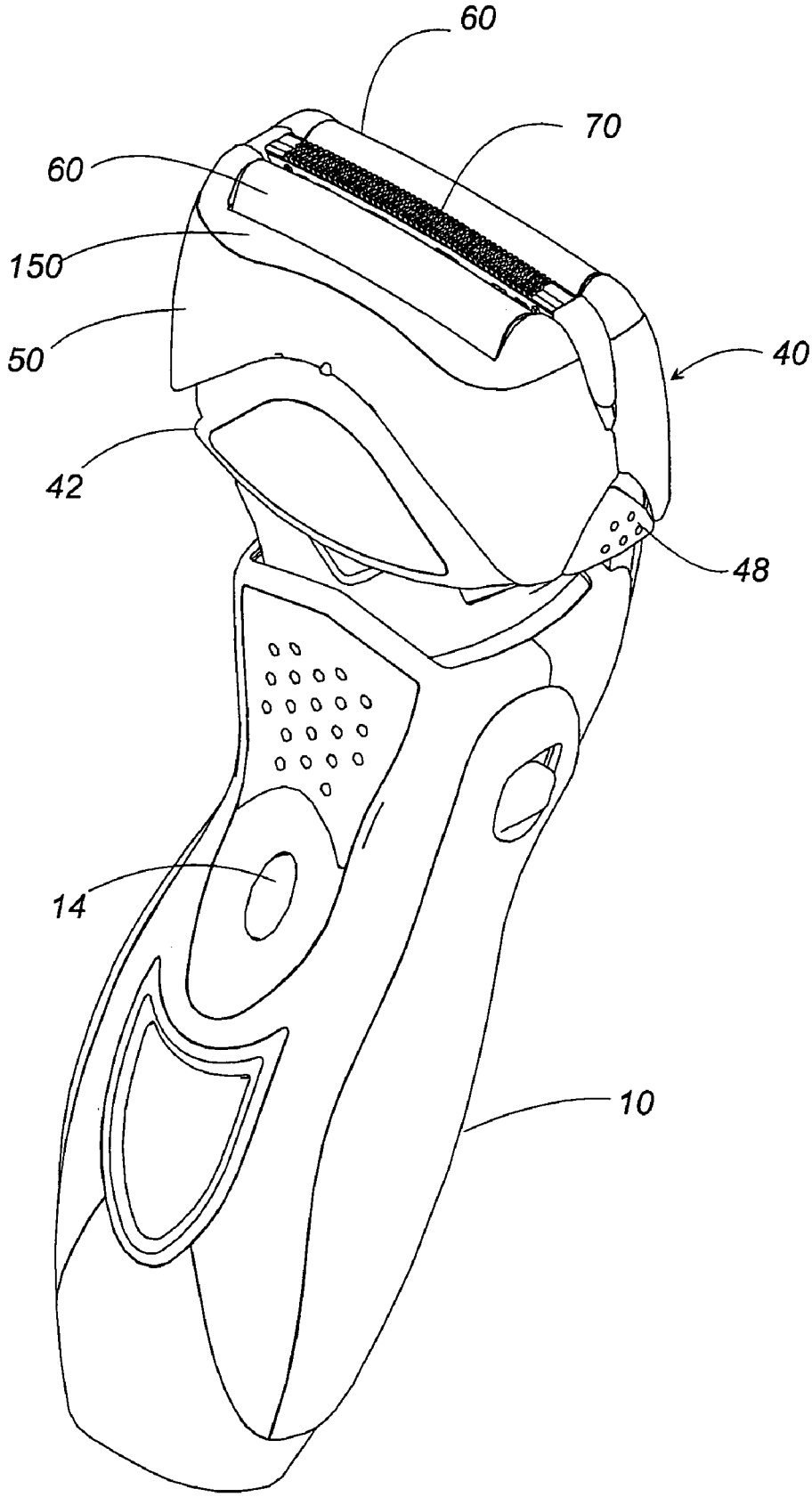
FIG. 1 is a perspective view of a reciprocatory dry shaver in accordance with a preferred embodiment of the present invention.
Figure 2:
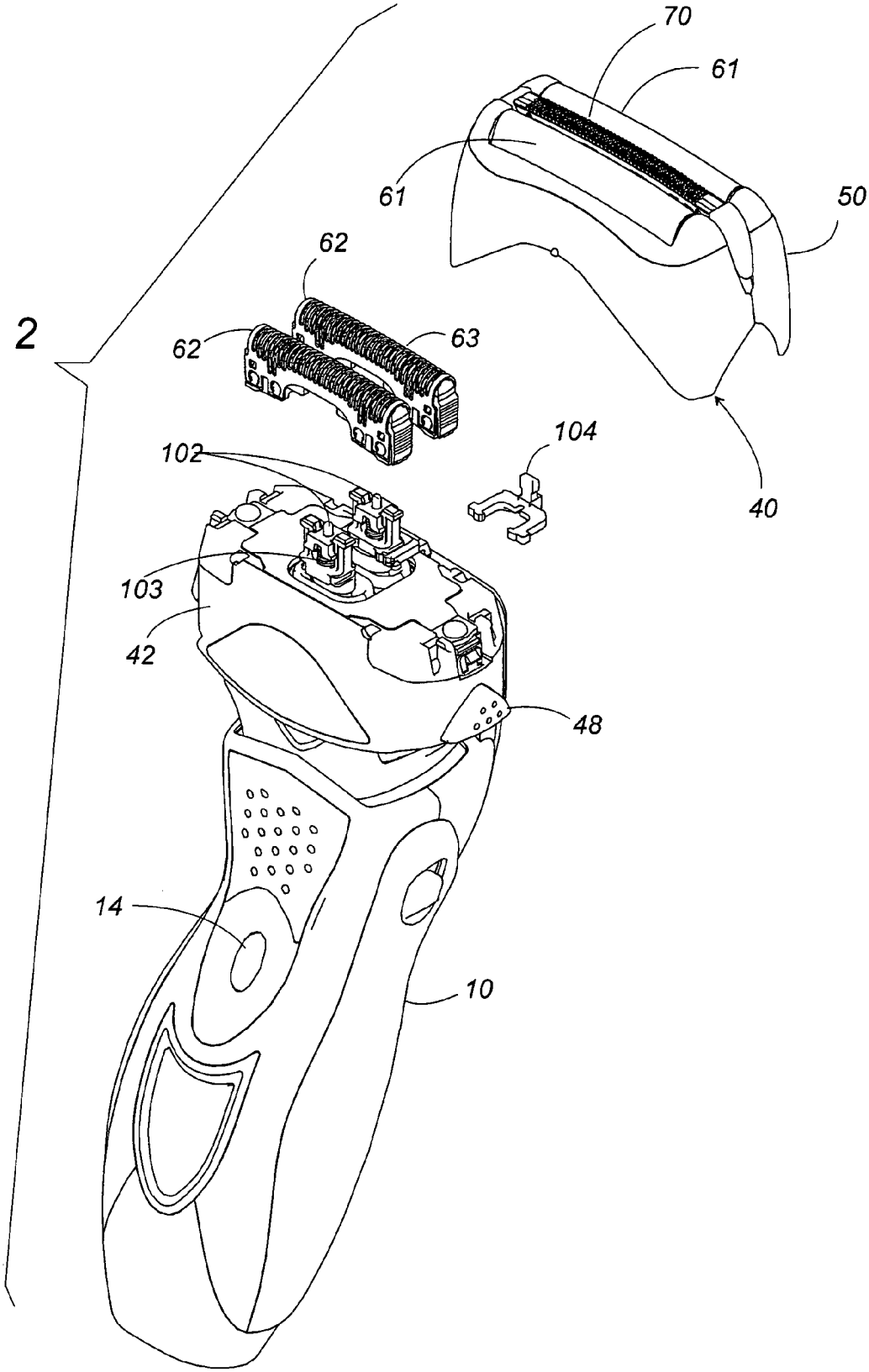
FIG. 2 is an exploded perspective view of the dry shaver.
Figure 3:
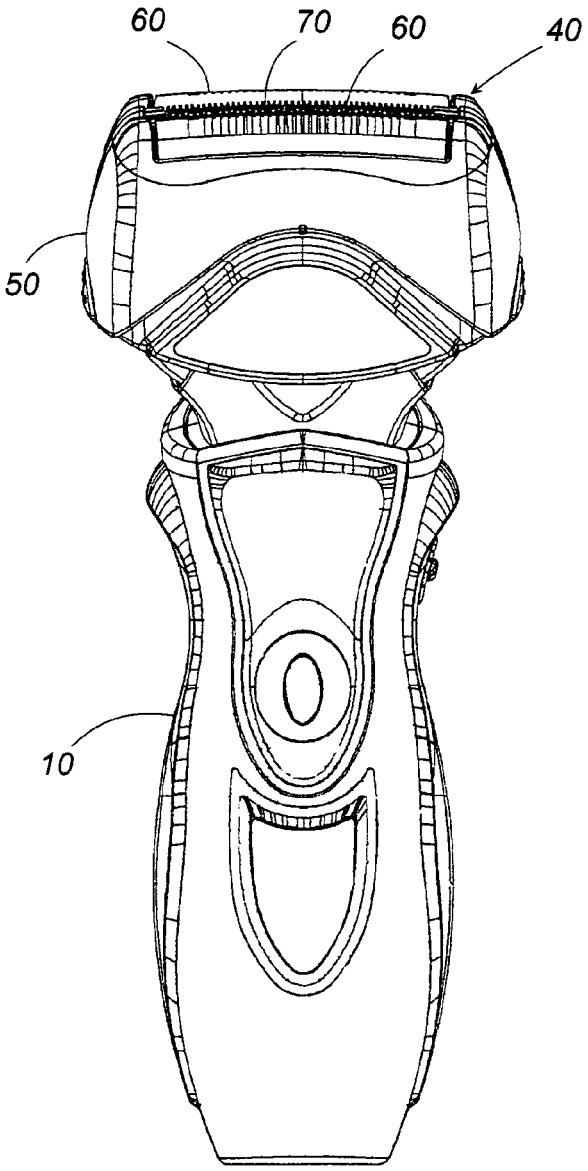
FIG. 3 is a front view of the dry shaver.
Figure 4:
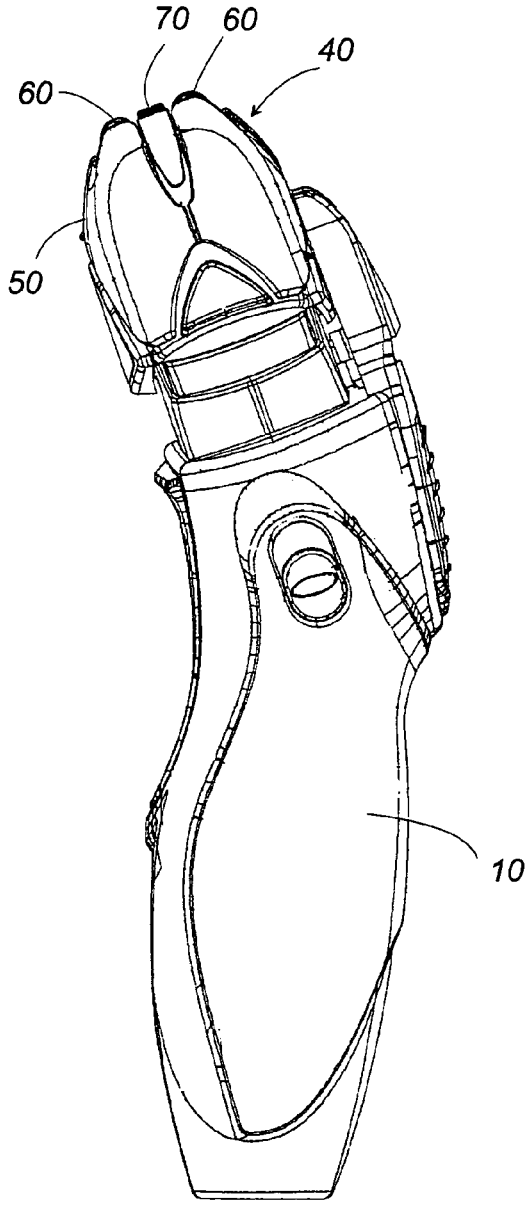
FIG. 4 is a side view of the dry shaver.

Referring now to FIGS. 1 to 6, there is shown a dry shaver in accordance with a preferred embodiment of the present invention. The shaver is basically composed of a grip 10 shaped to be grasped by a user' hand, and a shaving head 40 mounted on top of the grip 10 to be swingable relative thereto. The grip 10 accommodates electronic components forming a power supply and a switch actuated by a button 14 on the exterior of the grip 10. The shaving head 40 is supported to the grip through a linkage mechanism 90 by which the shaving head 40 is allowed to swing relative to the grip 10 about a swing axis running in the thickness direction of the shaving head 40.

The shaving head 40 is elongated to have a lengthwise axis and carries two foil cutter units 60 and a slit cutter unit 70. The foil cutter units 60 are disposed respectively on the front and rear upper ends of the shaver head in parallel relation with each other, while the slit cutter unit 70 is interposed between the foil cutter units 60. Each foil cutter unit 60 is designed for shaving relatively short hairs, and includes an outer cutter 61 with a plurality of perforations and an associated inner cutter 62 composed of a plurality of arcuate blades 63. The outer cutter 61 is shaped to have a generally U-shaped section and is curved arcuately along its length. The slit cutter unit 70 is designed for shaving relatively long hairs, and includes an elongated outer straight cutter with a plurality of slits and an inner cutter. Also included in the shaving head 40 is a cradle case 42 which mounts a detachable cutter holder 50 carrying the two outer cutters 61 and the slit cutter unit 70. The inner cutters 62 and 72 are driven by an actuator 100 to reciprocate relative to the outer cutters 61 and outer straight cutter 71. Release buttons 48 are provided on opposite ends of the cradle case 42 for releasably holding the cutter holder 50. The cradle case 42 is configured to accommodate therein the actuator 100 with two joints 102 which project on top of the cradle case 42 for connection with the inner cutters 62. Each joint 102 carries a spring 103 giving an upward spring bias to the inner cutter 62 to give an optimum contacting pressure between the inner cutter and the outer cutter 61. A pin is secured to one of the joints 102 and is detachably connected to the inner cutter of the slit cutter unit 70 for reciprocating the same.

The cradle case 42 has its top opening closed by a plate 46 through which the joints 102 extend for detachable connection with the inner cutters 62. A backup plate 45 is secured to the bottom of the case 42 for fixing the actuator 100 within the case 42. The link mechanism 90 is located on the backup plate 45 and includes a pair of arms 92 which are pivotally supported at their respective upper ends to the upper ends of props 96 projecting from the grip 10. The lower ends of the arms 92 are pivotally received on the backup plate 45 such that the cradle case 42 is suspended by the props 96 to be swingable in the longitudinal directions. The outer cutters 61 and the outer slit cutter 71 are exposed on top of the shaving head 40 to give a general cutting face for contact with a user's skin. A flexible tube 47 extends from the bottom of the cradle case 42 to seal leads which feed a current from the power supply to the actuator 100. Upon being energized, the actuator 100 drives the inner cutters to reciprocate for hair shaving.

The outer slit cutter of the slit cutter unit 70 is curved arcuately with a radius of curvature greater than that of the outer cutter 61 of the foil cutter unit 60 in order to come into contact with the skin over a wider range than the arcuately curved outer cutter 61. Thus, the outer slit cutter can bear the pressure applied against the skin over its length longer than the outer cutter 61, thereby avoiding the adjacent outer cutter 61 from being pressed excessively against the skin and therefore assuring a comfortable and efficient shaving at the foil cutter unit 60.

Figure 5:
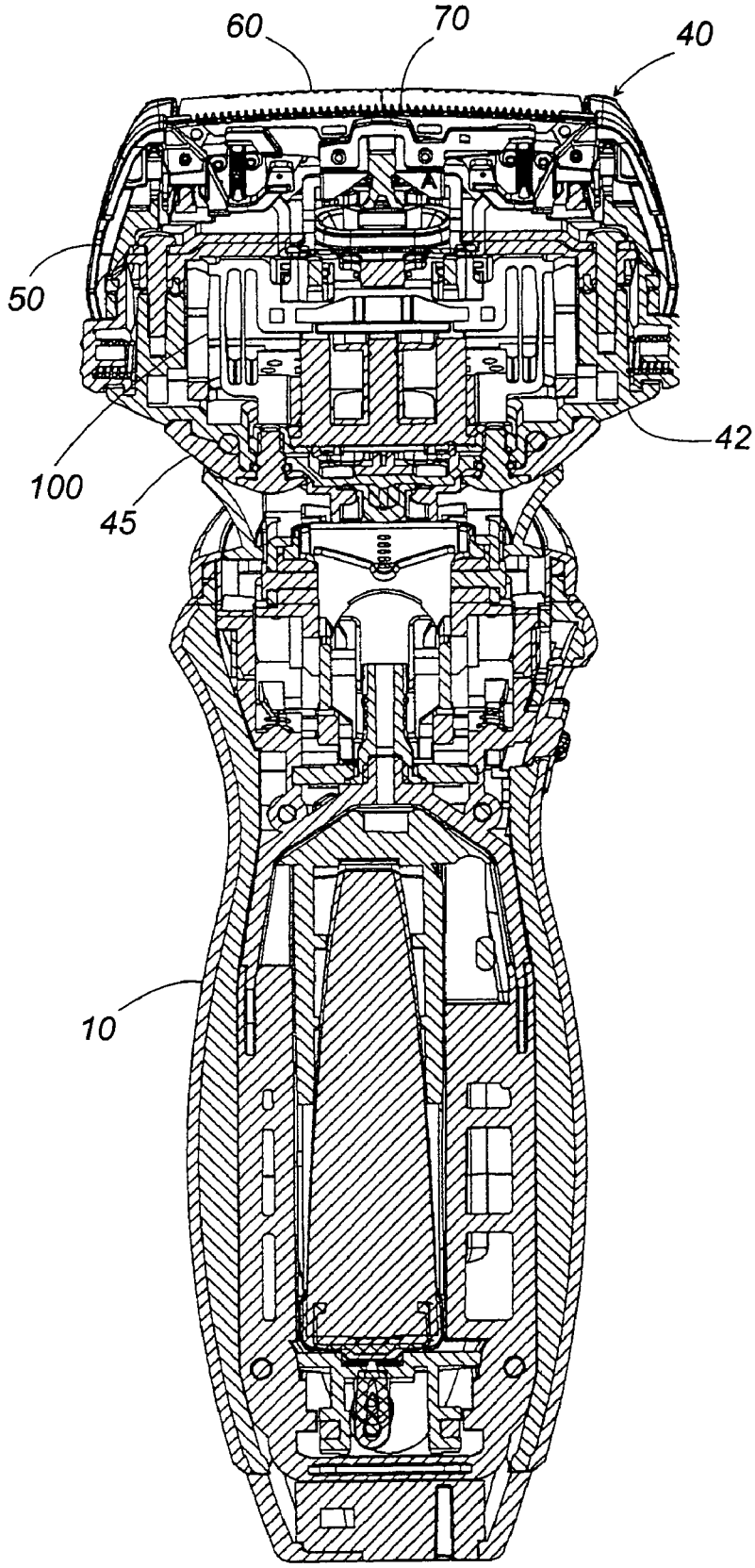
FIG. 5 is a vertical front section of the dry shaver.
Figure 6:
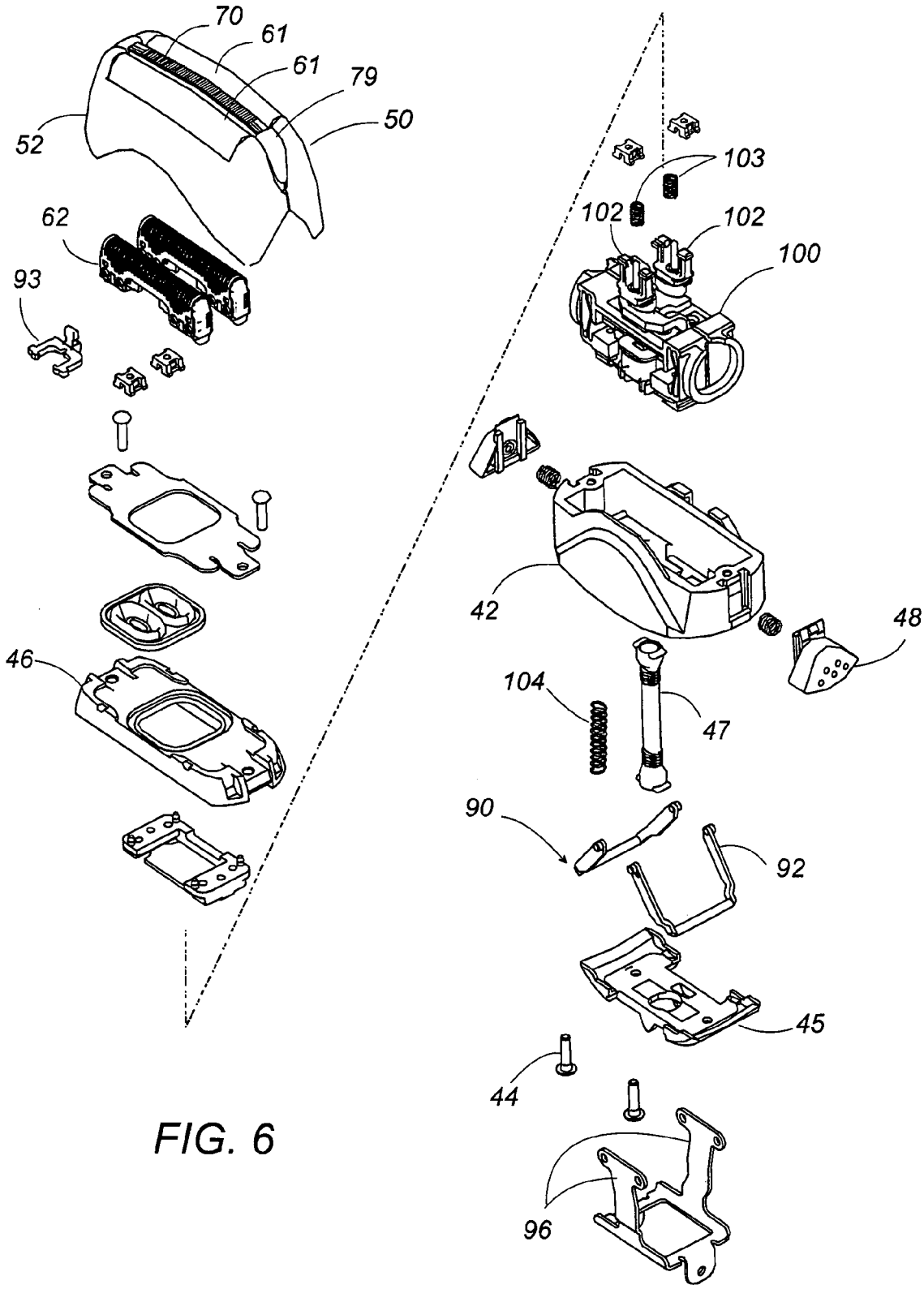
FIG. 6 is an exploded perspective view of a shaving head of the dry shaver.
Figure 7:
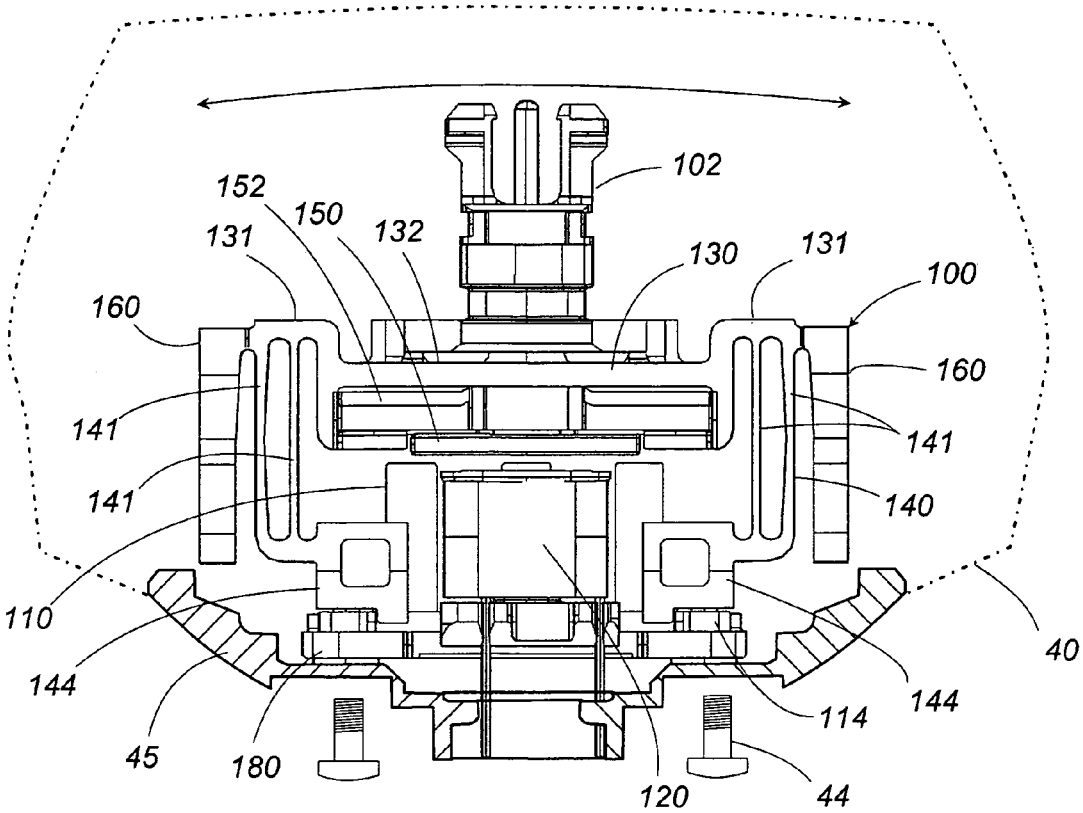
FIG. 7 is a front view of an actuator accommodated in the shaving head.

Referring now to FIGS. 7 to 10, an explanation is made to the actuator 100. The actuator includes two oscillators 130 commonly supported to a single stator assembly 110 to reciprocate in a reverse phase relation with each other, although the present invention is not limited thereto and may includes a single or more than two oscillators common to the one stator assembly 110. The stator assembly 110 includes an anchor plate 180 to be secured to the inner bottom of the shaving head 40 by means of screws 44, as shown in FIGS. 5 and 7. The stator assembly 110 carries an electromagnet 120, while each oscillator 130 carries a permanent magnet 150 and the joint 102. The electromagnet 120 includes an E-shaped stator having a center core 122 and a pair of side cores 123. A coil 124 is wound around the center core 122 to magnetize pole ends at the respective upper ends of the center and side cores to opposite polarity upon being energized.

Each oscillator 130 is molded with a plastic material and shaped into a rectangular plate formed on its upper center with a seat 132 for connection with the joint 102. The joint 102 is fixed by means of pins 134 and project upwardly from the seat 132. The permanent magnet 150 is supported on the lower center of each oscillator 130 through a backing magnetic yoke 152. Each oscillator 130 is also formed at its opposite longitudinal ends with raised shoulders 131 from which spring leaves 141 depend for connection with the stator assembly 110 and the anchor plate 180. The spring leaves 141 on the opposite ends of the oscillator 130 are cooperative with each other to define a resilient coupling link 140 for supporting the oscillators 130 to the stator assembly 110 and for allowing the oscillators 130 to reciprocate relative to the stator assembly 110 and therefore the shaving head 40. The permanent magnets 150 are positioned just above the cores of the electromagnet 120 with a small magnetic gap therebetween. Upon being supplied with an alternating current, the electromagnet 120 generates an alternating magnetic field which interacts with the permanent magnets 150 for reciprocating the oscillators 30 relative to the stator assembly 110 in the respective linear paths. The permanent magnets 150, each in the form of a horizontally extending flat bar, are magnetized to opposite directions so that the oscillators 130 are driven in a counter reciprocating manner, i.e., in the reveres phase relation with each other.

The two parallel spring leaves 141 depend from each raised shoulder 131 at each longitudinal end of the oscillator 130 and terminate commonly into a thickened mount 144 which is secured to each of flanges 114 at the lower end of the stator assembly 110 together with the anchor plate 180 by means of screws 184. Thus, each oscillator 30 is lifted above the stator assembly 110 and is allowed to reciprocate in a generally linear path by resiliently deforming the spring leaves 141. With this lifted-support of the oscillator 130, i.e., that each spring leaf 141 supports the oscillator 130 at its upper end and is anchored at its lower end to the shaving head 40, the inner cutter 62 carried on each oscillator 130 undergoes somewhat an arcuate path in conformity with the arc of the outer cutter 61 in smooth shearing contact therewith, as indicated by an arrowed line in FIG. 7. Further, with the provision of the raised shoulders 131 from which the spring leaves 141 depend, the spring leaves 141 are given a sufficient length of exhibiting resilient deformability required to reciprocate the oscillator 130, while reducing the overall height of the actuator including the joint 102 projecting from the seat of the oscillator 130. The oscillator 130 is molded from a plastic material to be integrated with the spring leaves 141 and the mounts 144. The mounts 144 belonging to one of the oscillators 130 are respectively integrated with the mounts 144 of the other oscillator 130 so that the two oscillators 130 are combined into a single module for easy mounting to the stator assembly 110. In view of that the oscillator 130 has to withstand a load applied to the inner cutter as a result of the shaving head 40 is pressed against the skin, the oscillator 130 is supported by use of two spring leaves 141 at either end. Three or more spring leaves 141 may be utilized for supporting the oscillator 130 successfully against the load applied thereto.

Figure 8:
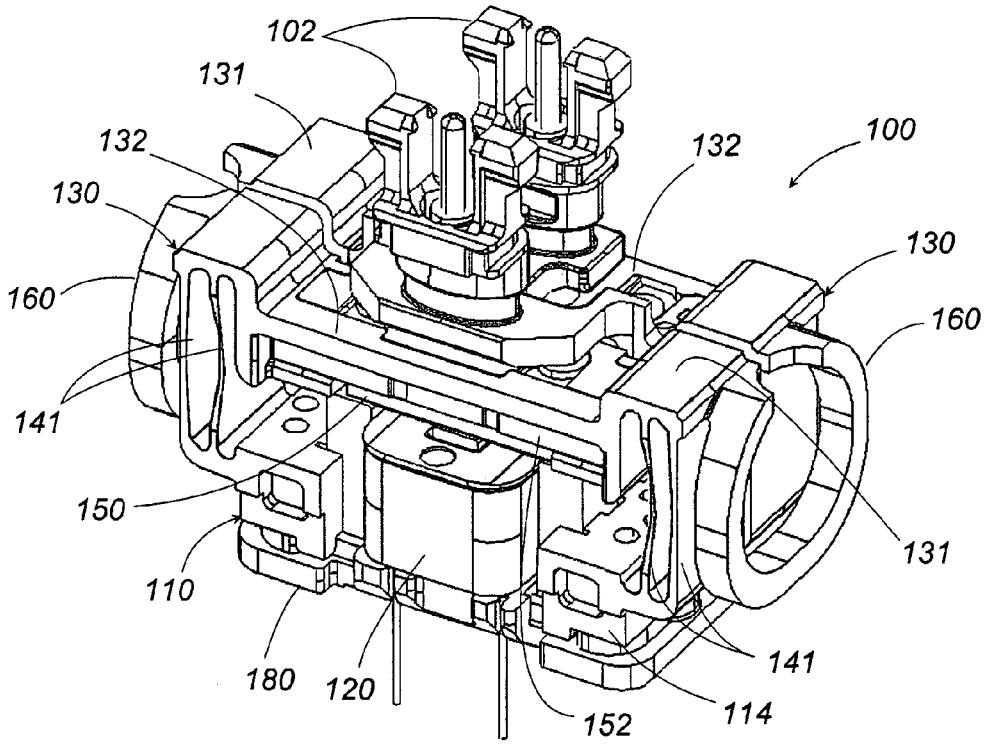
FIG. 8 is a perspective view of the actuator.
Figure 9:
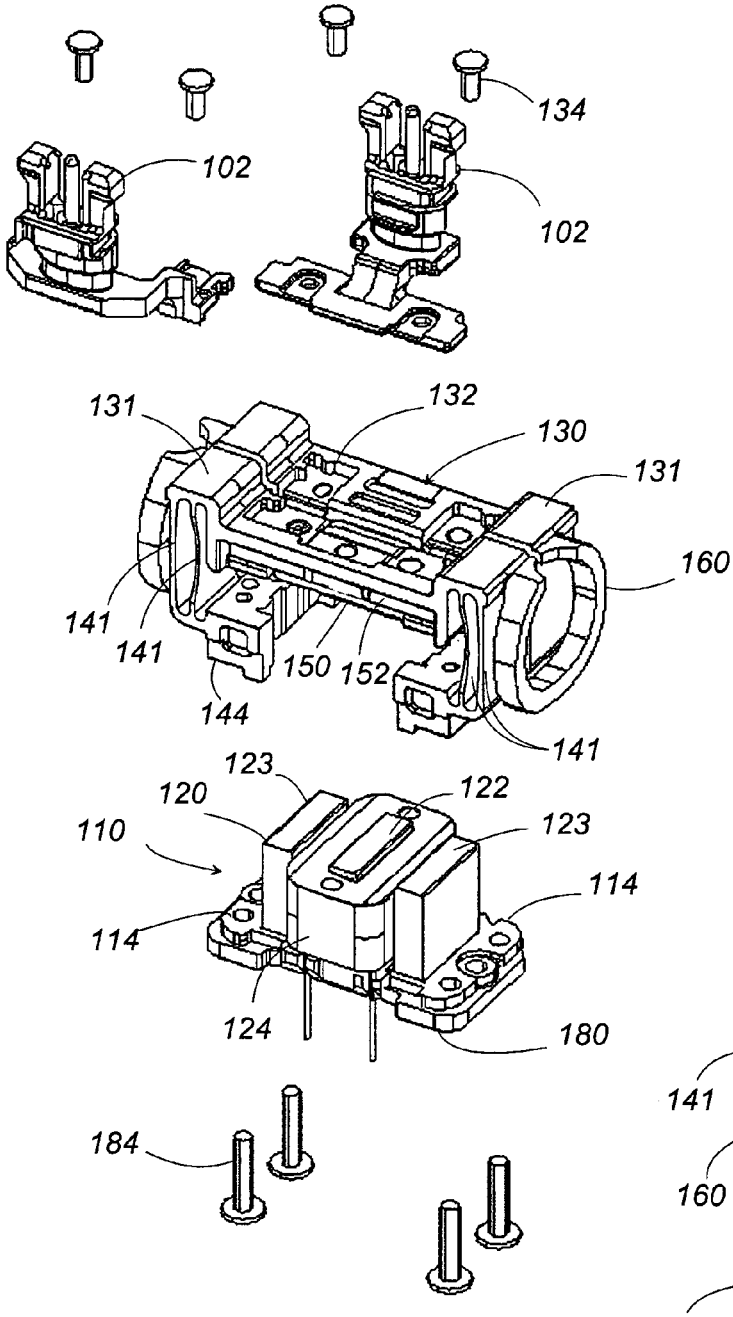
FIG. 9 is an exploded perspective view of the actuator.

As shown in FIG. 8, the inner spring leaf 141 is shaped to have a width narrower towards its lengthwise center than at the opposite lengthwise ends, while the outer spring leaf 141 is shaped to have uniform width. The inner spring leaf 141 is therefore given more resilient deformability than the outer spring leaf 141 for smoothly reciprocating the oscillator 130.

Figure 10:
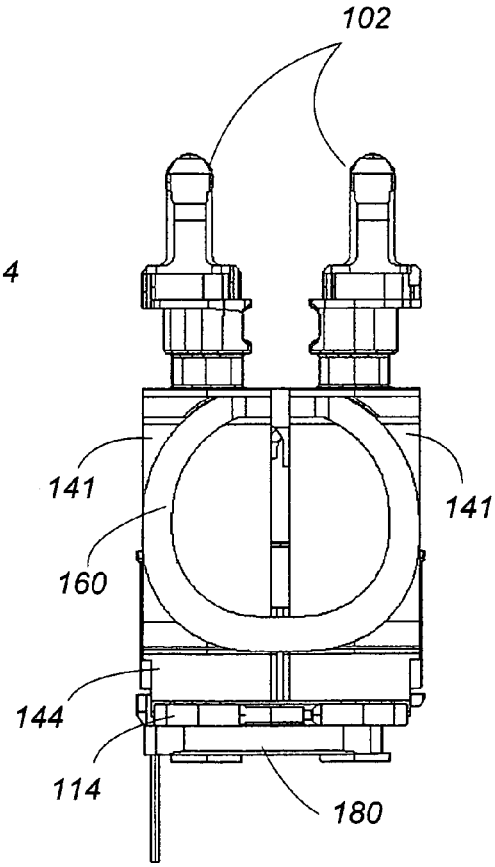
FIG. 10 is a side view of the actuator.

Further, the two oscillators 30 are interconnected by means of coupler springs 160 which assist the reverse phase relation between the two oscillators. The coupler spring 160 is configured to resiliently deform, in response to the linear movement of the one of the oscillators, so as to add a resulting bias to the other oscillator moving in the opposite direction for driving the load at an optimum output efficiency. The coupler spring 160 is molded integrally with the oscillators 130 to have a generally C-shape with the upper open ends respectively joined to the raised shoulder 131. The coupler spring 160 extends generally over the full length or height of the spring leaves 141 in a plane parallel to the spring leaves 141 and is confined within a full width of the parallel combination of the two oscillators 130, as shown in FIG. 10. With the C-shaped structure, the coupler spring 160 is given resilient deformability which allows the oscillators 130 to move relative to each other in a lengthwise direction of the oscillator as well as the vertical direction. Thus, the oscillators 130 can move along the linear path as well as the gap varying direction without being restricted by the coupler springs 160.

The invention claimed is:

1. A reciprocatory shaver comprising:

a shaving head carrying an elongated outer cutter which is arcuately curved along its length, and an inner cutter driven to reciprocate along the length of said outer cutter in hair shearing engagement with said outer cutter;

an actuator mounted in said shaving head for driving said inner cutter;

said actuator including an oscillator which reciprocates in a lengthwise direction and carries a joint for driving connection to said inner cutter, said actuator including a resilient coupling link which supports said oscillator to said shaving head so as to allow the oscillator to reciprocate relative to said shaving head, said actuator providing a linear motor composed of a permanent magnet carried on said oscillator, said resilient coupling link having its upper end coupled to said oscillator and, said resilient coupling link having its lower end being located farther away from said inner cutter than said oscillator along a direction perpendicular to the reciprocating direction of said oscillator, and being anchored to said shaving head.

2. The reciprocatory shaver as set forth in claim 1, wherein said resilient coupling link comprises a plurality of spring leaves depending from each of opposite lengthwise ends of said oscillator.

3. The reciprocatory shaver as set forth in claim 1, wherein said oscillator is elongated and is formed at its lengthwise center with a seat from which said joint projects towards said inner cutter, said oscillator being formed at its opposite lengthwise ends respectively with raised shoulders at a level higher than said seat, said actuator including an anchor plate extending in parallel with said oscillator and being fixed to said shaving head, said resilient coupling link comprising spring leaves extending respectively from said raised shoulders to the opposite ends of said anchor plate over a length longer than a distance from the seat.

4. The reciprocatory shaver as set forth in claim 3, wherein said oscillator is molded from a plastic material to be integrated with said spring leaves.

5. The reciprocatory shaver as set forth in claim 1, wherein said actuator includes an anchor plate extending in parallel with said oscillator and being fixed to said shaving head, said actuator providing an electromagnet fixed to said anchor plate.

* * * * *